US009500015B2

(12) United States Patent
Omann et al.

(10) Patent No.: US 9,500,015 B2
(45) Date of Patent: Nov. 22, 2016

(54) DRIVE DEVICE FOR A FURNITURE FLAP

(75) Inventors: Christian Omann, Hard (AT); Wofgang Bohle, Götzis (AT)

(73) Assignee: Julius Blum GmbH, Hochst (AT)

( * ) Notice: Subject to any disclaimer, the term of this patent is extended or adjusted under 35 U.S.C. 154(b) by 1195 days.

(21) Appl. No.: 13/033,955

(22) Filed: Feb. 24, 2011

(65) Prior Publication Data

US 2011/0138960 A1 Jun. 16, 2011

Related U.S. Application Data

(63) Continuation of application No. PCT/AT2009/000290, filed on Jul. 28, 2009.

(30) Foreign Application Priority Data

Aug. 29, 2008 (AT) ..... A 1347/2008

(51) Int. Cl.
*A47B 95/02* (2006.01)
*A47B 88/00* (2006.01)
(Continued)

(52) U.S. Cl.
CPC ..... *E05F 1/1041* (2013.01); *E05C 19/165* (2013.01); *E05D 15/262* (2013.01); *E05F 1/1058* (2013.01); *E05D 11/1064* (2013.01); *E05Y 2201/22* (2013.01);
(Continued)

(58) Field of Classification Search
CPC E05F 1/1041; E05F 1/1058; E05Y 2900/20; A47B 96/00; A47B 88/0477
USPC ..... 312/323, 324, 325, 326, 327, 328, 329, 312/319.5, 319.7, 319.2; 49/386, 387, 246, 49/247, 248, 249; 16/286
See application file for complete search history.

(56) References Cited

U.S. PATENT DOCUMENTS 3,376,088 A * 4/1968 Bol et al. ..... 292/353
7,178,202 B2 * 2/2007 Hirtsiefer et al. ..... 16/366
(Continued)

FOREIGN PATENT DOCUMENTS

DE 20 2004 007168 9/2004
DE 20 2006 000535 4/2006
(Continued)

OTHER PUBLICATIONS

Machine Translation of DE202006000535 (BLUM), retrieved on Nov. 19, 2012, www.espacenet.com.*
(Continued)

*Primary Examiner* — Daniel J Troy
*Assistant Examiner* — Kimberley S Wright
(74) *Attorney, Agent, or Firm* — Wenderoth, Lind & Ponack, L.L.P.

(57) ABSTRACT

A drive device for a flap of a piece of furniture including at least one actuating arm which is activated by a spring device and is intended for moving the flap. A pushing-out device can move the flap from the closed position the opening direction toward the open position over a first opening-angle range (M1). The spring device exerts substantially no force on the flap in the first opening-angle range (M1), and the spring device moves the flap in the opening direction only in a second opening-angle range (M2), wherein the second opening-angle range (M2) adjoins the first opening-angle range (M1) or, at most, slightly overlaps the first opening-angle range.

17 Claims, 7 Drawing Sheets

(51) Int. Cl.

| | |
|---|---|
| ***E05F 1/08*** | (2006.01) |
| ***E05F 1/10*** | (2006.01) |
| ***E05C 19/16*** | (2006.01) |
| ***E05D 15/26*** | (2006.01) |
| *E05D 11/10* | (2006.01) |

(52) U.S. Cl.

CPC ... *E05Y 2201/232* (2013.01); *E05Y 2201/424* (2013.01); *E05Y 2201/618* (2013.01); *E05Y 2800/11* (2013.01); *E05Y 2900/20* (2013.01); *Y10T 74/20341* (2015.01)

(56) References Cited

U.S. PATENT DOCUMENTS

| | | | | |
|---|---|---|---|---|
| 7,240,974 | B2 * | 7/2007 | Hirtsiefer | 312/109 |
| 7,562,757 | B2 * | 7/2009 | Dubach et al. | 192/215 |
| 7,887,147 | B2 * | 2/2011 | Karg | 312/319.2 |
| 8,029,078 | B2 * | 10/2011 | Gasser | 312/319.5 |
| 8,066,341 | B2 * | 11/2011 | Brustle | 312/319.5 |
| 8,109,583 | B2 * | 2/2012 | Bruestle | 312/319.2 |
| 8,282,175 | B2 * | 10/2012 | Herper et al. | 312/319.2 |
| 8,360,537 | B2 * | 1/2013 | Gasser | 312/319.5 |
| 8,376,420 | B2 | 2/2013 | Peterlunger | |
| 2007/0180654 | A1 * | 8/2007 | Gasser | 16/242 |
| 2008/0048538 | A1 * | 2/2008 | Karg | 312/319.2 |
| 2008/0100189 | A1 * | 5/2008 | Huber | 312/319.1 |
| 2008/0121490 | A1 * | 5/2008 | Dubach et al. | 192/17 D |
| 2008/0122332 | A1 * | 5/2008 | Brustle | 312/319.2 |
| 2009/0064457 | A1 * | 3/2009 | Brustle | 16/292 |
| 2010/0162847 | A1 * | 7/2010 | Gassner | 74/490.07 |
| 2011/0131884 | A1 * | 6/2011 | Herper et al. | 49/386 |
| 2012/0161598 | A1 * | 6/2012 | Blum | 312/319.2 |

FOREIGN PATENT DOCUMENTS

| | | | | |
|---|---|---|---|---|
| DE | 201 22 712 | | 5/2007 | |
| EP | 0 391 221 | | 9/1995 | |
| EP | 1 148 200 | | 9/2006 | |
| EP | 1 296 011 | | 6/2009 | |
| EP | 1 835 107 | | 9/2009 | |
| EP | 1 840 309 | | 9/2010 | |
| WO | 2007/101287 | | 9/2007 | |
| WO | WO 2008022673 | A1 * | 2/2008 | E05F 11/54 |
| WO | WO 2008098267 | A1 * | 8/2008 | A47B 88/04 |

OTHER PUBLICATIONS

International Search Report issued Oct. 30, 2009 in International (PCT) Application No. PCT/AT2009/000290.

Austrian Patent Office Search Report dated Jun. 17, 2009 in Austrian Patent Application No. A 1347/2008.

* cited by examiner

DRIVE DEVICE FOR A FURNITURE FLAP

This application is a Continuation of International application No. PCT/AT2009/000290, filed Jul. 28, 2009, the entire disclosure of which is incorporated herein by reference.

BACKGROUND OF THE INVENTION

The present invention relates to a drive device for a flap of an article of furniture having at least one actuating arm which is or can be acted upon by a spring device for moving the flap, and an ejector device by way of which the flap is movable over a first opening angle range from the closed position in the direction of the open position.

The invention further concerns an article of furniture having a drive device of the kind to be described.

Such a drive device is known, for example, from German Utility Model specification DE 20 2006 000 535 U1, wherein there is provided an ejector device having a Touch-latch functionality for ejecting the flap from a closed end position. There is also an additional spring device which provides compensation for the weight of the flap. The spring device, however, also applies to the flap a relatively high force for holding the flap closed so that towards the end of the closing movement, after moving beyond a dead center point position, the flap is pushed towards the fully closed position and is held in that end position by a given closing force. A disadvantage with that state of the art is the fact that the ejector device—when the flap in the completely closed position—has to overcome the force of the spring device, and that also requires an ejector device of relatively great dimensions.

It is therefore an object of the present invention to provide a drive device of the general kind set forth above, avoiding the above-mentioned disadvantage.

SUMMARY OF THE INVENTION

According to the invention, an advantageous configuration is achieved in that the spring device exerts substantially no force on the flap in the first opening angle range, and the spring device moves the flap in the opening direction only in a second opening angle range. The second opening angle range adjoins the first opening angle range or at most somewhat overlaps therewith.

In other words, the ejector device and the spring device are matched to each other so that in the closed position, the spring device exerts substantially no force on the flap so that the ejector device, for ejection of the flap, has to overcome substantially only the moment of inertia of the flap (having regard to the angular speed to be achieved by the flap). The flap can thus be particularly easily moved out of the closed end position.

The force of the ejector device can be relatively low in that way, and it can thus be of a space-saving and inexpensive implementation. It is only towards the end of the ejection stroke movement of the ejector device—preferably subsequently to that ejection stroke movement—that the spring device begins to act so that an active pivotal moment is exerted in the opening direction on the actuating arm (and thus on the flap pivotably connected thereto) so that the flap is moved automatically upwardly by the force of the spring device.

In one embodiment, the drive device has precisely one spring device. In principle, it is admittedly conceivable that the drive device could include two or more spring devices which however are all operative in the second opening angle range (for example in the form of a relay race). In an aspect of the invention, however, it is desirable if the spring device or devices exerts or exert no pulling closure force on the flap in the first opening angle range or does not provide any spring force which holds the flap in the completely closed position.

In another embodiment of the invention, adjoining the second opening angle range is a third opening angle range in which the spring device holds the flap in a substantially balanced relationship. In that way, the flap is held substantially in any open position in a range immediately prior to the completely open position, whereby the flap is not necessarily pushed towards the fully open position. It will be noted, however, that it is also possible for the flap to be moved into the fully open position by the spring device, and a damping device can be provided for damping the last opening movement of the flap.

In another possible embodiment of the invention, the first opening angle range—starting from the completely closed position of the flap—can extend between 0° and 10°, preferably between 0° and 5°. It may also be desirable if the second opening angle range is operative up to about 30°, preferably about 10°, in the open position of the flap.

An advantageous configuration is afforded if a control cam mounted about an axis of rotation and with an actuating contour formed or arranged thereon is operative between the spring device and the actuating arm, and a pressure roller runs against the actuating contour during the pivotal movement of the actuating arm. In that connection, it may be advantageous if the curve portion of the actuating contour—which is in engagement with the pressure roller during the first opening angle range of the flap—has at least approximately the same radial spacing relative to the axis of rotation of the control cam (i.e., has an approximately uniform radius). The approximately equal radial spacing of that cam portion (i.e., uniform radius) makes it possible to avoid the spring device exerting a substantial force on the flap in the very last closing range. It would at most even be possible to tolerate a slight closing force on the part of the spring device as long as the opposite force of the ejector device is correspondingly greater.

To achieve a particularly compact structure it may be desirable if the spring device and the ejector device are arranged in a common structural unit. It will be appreciated that it is also possible for the spring device and the drive device to be arranged in mutually separate structural units. In that way, existing actuating drives can possibly be subsequently fitted with an ejector device.

The ejector device can act directly or indirectly on the flap. Alternatively or supplementally, however, it is also possible for the ejector device to act on the actuating arm. In a desirable configuration, it can be provided that the ejector device has at least one, preferably lockable, force storage means, by which an ejector element can be acted upon for ejection of the flap and/or for ejection of the actuating arm.

There are a number of possible options for implementing the ejector device. In this connection, all Touch-latch functionalities known from the state of the art can be considered, as is also described inter alia in DE 20 2006 000 535 U1 to the present applicant. The force storage means can therefore have at least one mechanical spring element and/or can be at least partially formed by an electric motor. Force storage means in the form of gas pressure springs and/or a solenoid can also be envisaged. The force storage means can be loaded up upon opening or upon closing, in which case the Touch-latch fitment can be triggered by pulling on the flap and/or by manually exerting pressure on the flap (starting from the closed position). In the case of triggering by exerting pressure on the flap, it may be desirable if the flap has a first end position which corresponds to the closed position of the flap and that the flap, starting from that first end position, is movable by exerting pressure in the closing direction thereof into a second end position closer to the furniture carcass.

So that the flap is sufficiently stably held relative to the furniture carcass in the completely closed position, it may be desirable if the flap is held in the closed position by a restraining device. Thus, there can be a per se known structure, wherein the restraining device includes at least two portions. A first portion can be arranged on the furniture carcass, and a second portion can be arranged on the flap, and the two portions exert a magnetic attraction force on each other in the closed position of the flap.

Alternatively, a pull-in device can also be used as the restraining device, as have for example already long been known in relation to drawer extension guide arrangements. As an example in that respect, attention is to be directed to EP 0 391 221 B1 to the present applicant. Those pull-in devices usually have at least one coupling portion, wherein a coupling portion associated with the furniture carcass can be coupled to an entrainment member associated with the flap towards the end of the flap closing movement, whereupon the coupled entrainment member (and therewith the flap) can be pulled into the completely closed position by a force storage device. It will be appreciated that the closing movement can also be damped by a damper to prevent the flap from hitting hard against the furniture carcass.

The restraining device can, in principle, also be in the form of a simple locking device which can be released again by the ejector device. It will be appreciated that in all variants of the restraining device, the force of the ejector device, in opposition to the restraining device, must be sufficiently higher to permit the flap to be reliably ejected from the closed end position.

BRIEF DESCRIPTION OF THE DRAWINGS

Further details and advantages of the present invention will now be described with reference to the specific description and drawings. In the drawings.

DETAILED DESCRIPTION OF THE INVENTION

Figure 1:
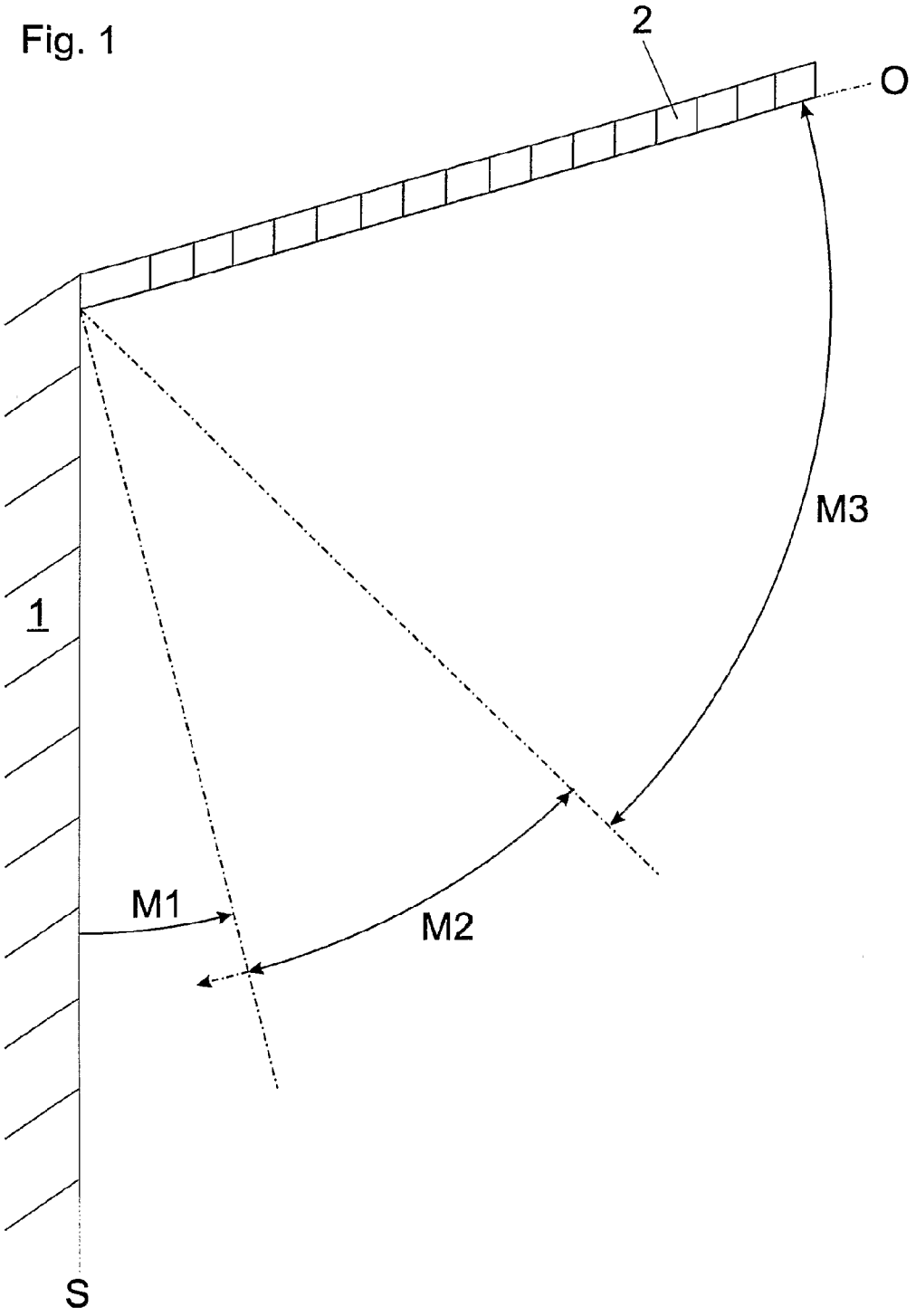
FIG. 1 shows a diagrammatic view of the opening angle ranges of the flap.

FIG. 1 shows a diagrammatic view of the various opening angle ranges M1, M2 and M3 of a flap 2 which is movable upwardly relative to a furniture carcass 1. In this diagrammatic view, the flap 2 is in the completely open position. The flap 2 is mounted movably between a vertical position closing a cupboard compartment in the furniture carcass 1 (characterized by the vertical axis S) and an upwardly moved open position (axis O). An ejector device (not shown) is provided for ejecting the flap 2 from the closed position, while a spring device (also not shown) is provided to compensate for or to at least partially assist with the opening movement. Starting from the completely closed position of the flap 2 (vertical axis S), the flap 2 is moved by the ejector device over the first opening angle range M1 in the opening direction toward the open position, wherein substantially no force is exerted on the flap 2 by the spring device in that first opening angle range M1. In that way, the flap 2 can be particularly easily moved out of the closed position. Towards the end of the first opening angle range M1, there is a second opening angle range M2 which either adjoins the first opening angle range M1 or at most somewhat overlaps therewith. That overlap is symbolically identified by the broken extension line of the second opening angle range M2. In the second opening angle range M2, an active pivotal movement is exerted on the flap 2 by the provided spring device so that following the ejection stroke movement of the ejector device, the flap 2 is moved in the opening direction toward the open position by the spring device (also without manual assistance for the flap 2). Provided subsequently to the second opening angle range M2, there is a third opening angle range M3 in which the spring device holds the flap 2 in a substantially tared condition. In that case, therefore, the flap 2 is held within the third opening angle range M3 substantially in any pivotal position against the force of gravity so that the flap 2 is not automatically pushed into the completely open position, for reasons of improved accessibility.

Figure 2A:
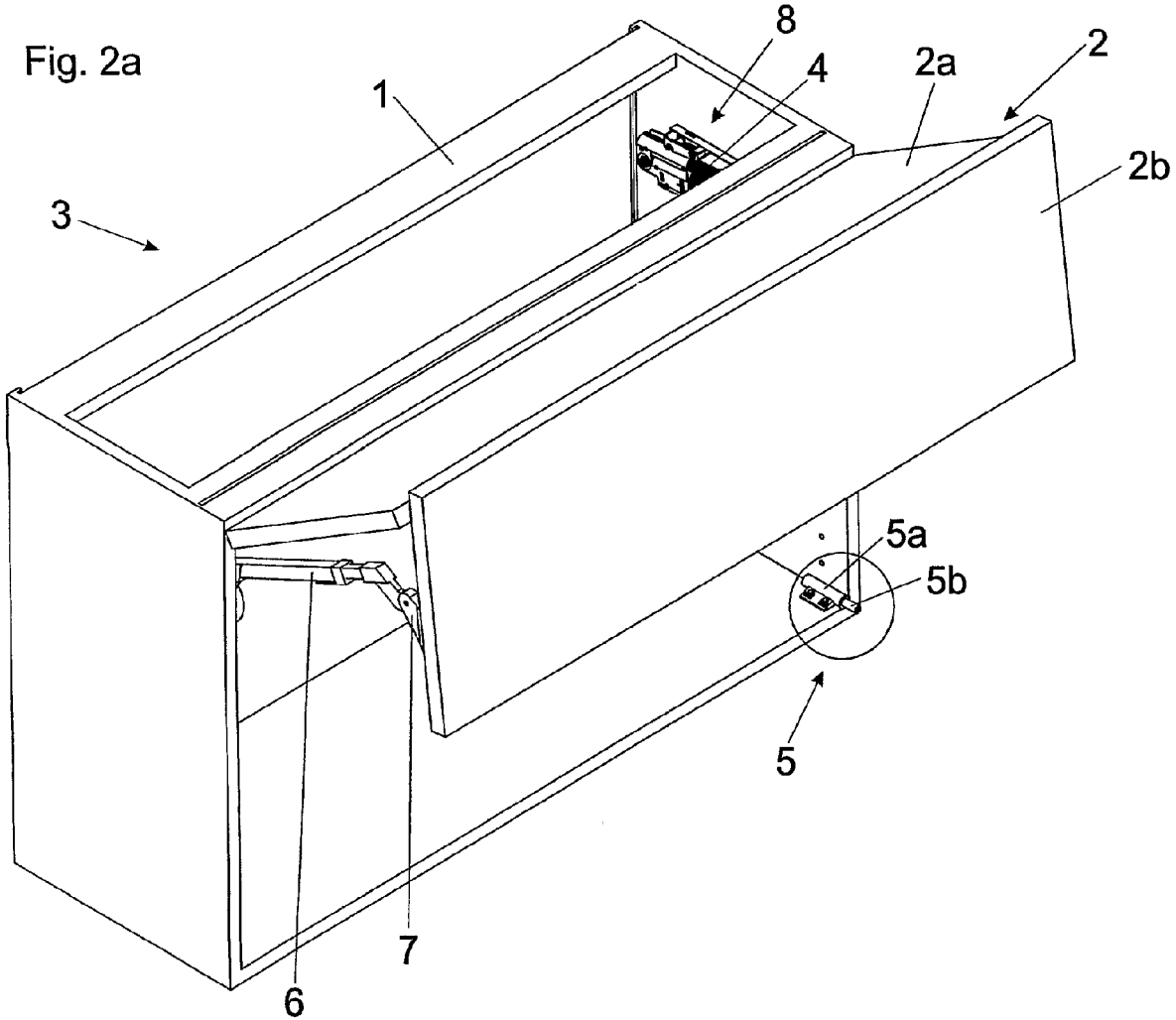
FIGS. 2*a*, 2*b* show a perspective view from the front, and an enlarged detail view thereof of the article of furniture.

FIG. 2*a* shows a possible embodiment of an article of furniture 3, wherein an upwardly movable flap 2 is mounted displaceably relative to a furniture carcass 1. The flap 2 in the illustrated Figure includes two flap portions 2*a* and 2*b*, wherein the upper flap portion 2*a* is pivotable relative to the furniture carcass 1 and the lower flap portion 2*b* is mounted rotationally hingedly relative to the upper flap portion 2*a*. In the illustrated view, the flap 2 is an open position. When the flap 2, starting from the illustrated position, is moved into the closed position, the two flap portions 2*a* and 2*b* move away from each other again until in the closed position they form a common plane and close the cupboard compartment of the furniture carcass 1 in a vertical position. To move the flap 2, there is firstly provided an actuating drive 8 having a spring device 4 acting on an actuating arm 6. The actuating drive 8 is preferably mounted to both oppositely disposed side walls of the furniture carcass 1. The actuating arm 6 of the right-hand actuating drive 8 is concealed by the flap 2 in the illustrated Figure. In addition, to move the flap 2, there is an ejector device 5 by which the flap 2 is moved starting from the completely closed position over the first opening angle range M1 shown in FIG. 1. For reasons of clarity, the ejector device 5 is illustrated as a structural unit separate from the actuating drive 8, but it will be appreciated that the ejector device 5 can also be an integral part of the actuating drive 8. The spring device 4 of the actuating drive 8 exerts substantially no force on the actuating arm 6 while the actuating arm 6 is in the immediate proximity of the completely closed position so that the flap 2 is particularly easily movable into an open position by the ejector device 5. The actuating arm 6 is, on the one hand, mounted about a horizontal axis relative to the furniture carcass 1 while, on the other hand, it is also pivotably connected about a horizontal axis to a fitment 7 associated with the lower flap portion 2*b*.

Figure 2B:
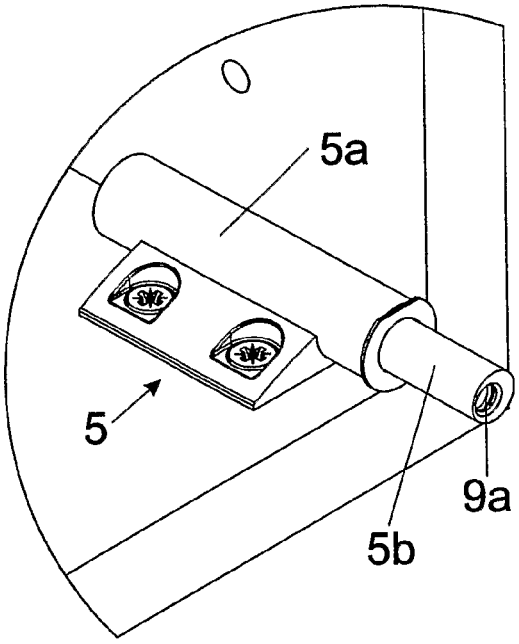

FIG. 2*b* shows an enlarged view of the region circled in FIG. 2*a*. It is possible to see the ejector device 5 which has a housing 5*a* and an ejector element 5*b* which is mounted movably relative to the housing 5*a*. As in the discussed embodiment, the ejector element 5*b* can be linearly displaceable relative to the housing 5*a*. The ejector device 5 has, for example, a Touch-latch functionality, wherein a lockable force storage means is arranged within the housing 5*a*. As shown, the ejector element 5*b* can act on the flap 2 or, in a variant, also on the actuating arm 6. The ejector device 5 can be triggered either by pressure applied to the flap 2 or by pulling on the flap 2. More details of the functionality of such touch-latch devices will not be described in the context of the present invention as they have long been known in the state of the art.

Figure 3:
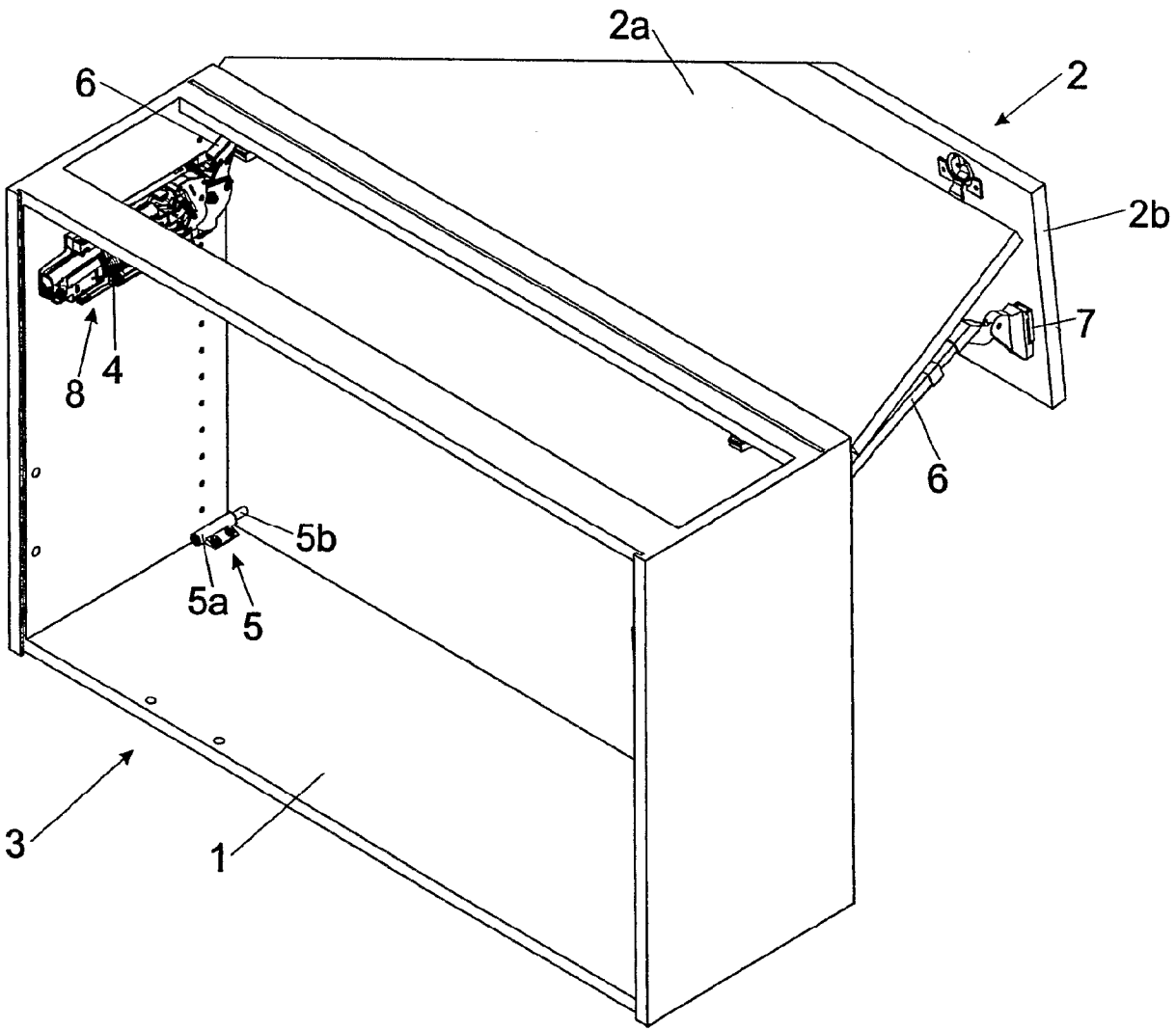
FIG. 3 shows a perspective view from the rear of the article of furniture.

It is also possible to see in FIG. 2*b* a first portion 9*a* forming a portion of a restraining device 9 for holding the flap 2 closed. The restraining device 9 serves for fixing the flap in the completely closed position and is described in greater detail hereinafter. FIG. 3 shows a perspective view from the rear of the article of furniture 3, the rear wall of the furniture carcass 1 being omitted for the sake of enhanced clarity of the drawing. It is possible to see the actuating drive 8 with the spring device 4, by which the actuating arm 6 can be acted upon to move the flap 2. The ejector device 5, arranged on or in the furniture carcass 1, with the housing 5*a* and the ejector element 5*b* movable relative thereto in the form of a push rod, acts on the lower flap portion 2*b* in the closed position.

Figure 4:
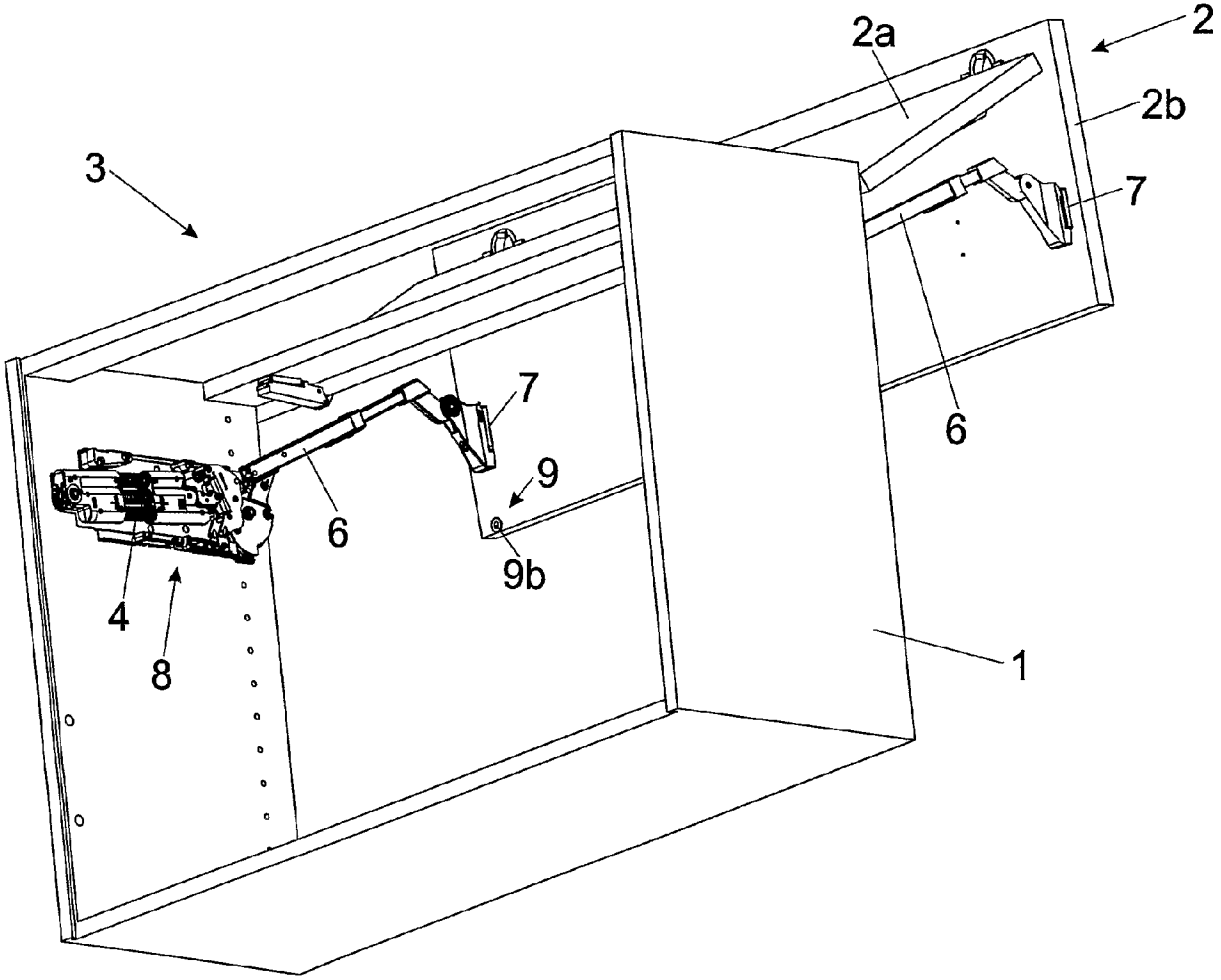
FIG. 4 shows a further perspective view from the rear of the article of furniture.

FIG. 4 also shows a perspective view from the rear of the article of furniture 3. It is possible to see here a second portion 9*b* of a restraining device 9 by which the flap 2 can be sufficiently stably held in the completely closed position. In the illustrated Figure, the restraining device 9 includes the second portion 9*b* which in the closed position of the flap 2 is magnetically connected to the first portion 9*a* arranged in the ejector element 5*b* (FIG. 2*b*). In that way, the flap 2 is sufficiently stably held to the furniture carcass, but the magnetic force can be overcome by triggering the ejector device 5 so that the flap 2 is movable into an open position.

Figure 5A:
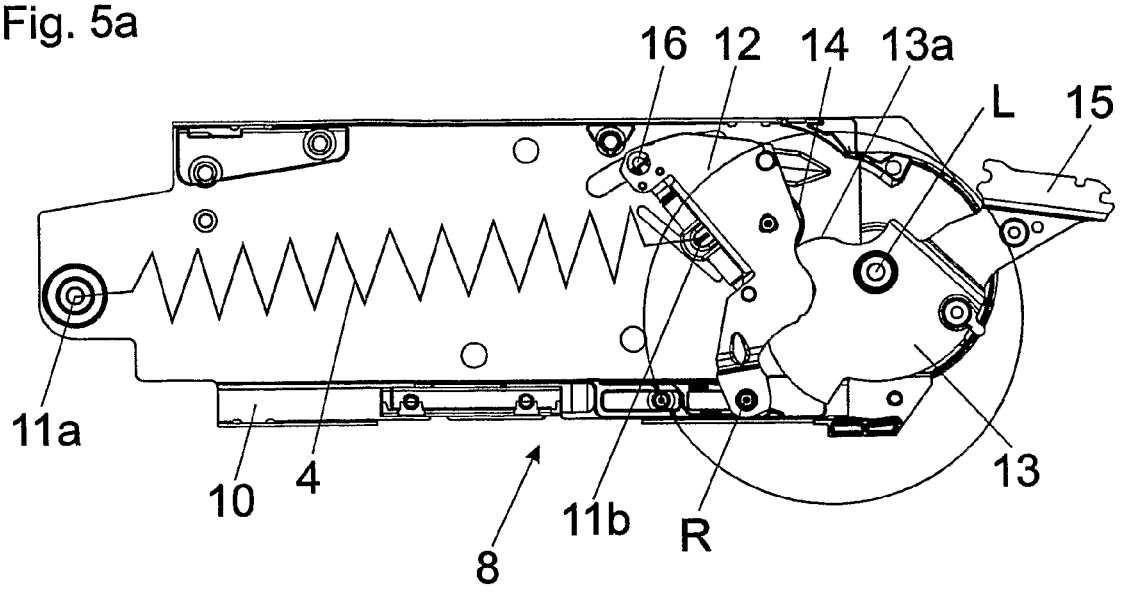
FIGS. 5*a*, 5*b* show a possible embodiment of an actuating drive for moving the flap.

FIG. 5*a* shows a possible embodiment of the actuating drive 8 to be fixed to at least one side wall of the furniture carcass 1. The actuating drive 8 includes a housing 10 with a first spring mounting 11*a* at which the diagrammatically illustrated spring device 4 is supported. In addition, there is an intermediate lever 12 which is pivotable about the axis of rotation R, the spring device 4 acting on the second spring mounting 11*b* on the intermediate lever 12. The spring mounting 11*b* is displaceable by an adjusting device 16 in a variable state relative to the axis of rotation R of the intermediate lever 12 so that the force of the spring device 4 can be selectively adjusted to the weight of the flap 2 to be moved. In addition, there is a control cam 13 which is mounted rotatably about the axis of rotation L and has an actuating contour 13*a*. A pressure roller 14 associated with the intermediate lever 12 is pressed against the actuating contour 13*a* of the control cam 13 by the force of the spring device 4. During the closing movement of the actuating arm 6 (not shown here), the pressure roller 14 runs along the actuating contour 13*a* of the control cam 13. The rotatable control cam 13 has a coupling portion 15 onto which the actuating arm 6 can be snapped.

Figure 5B:
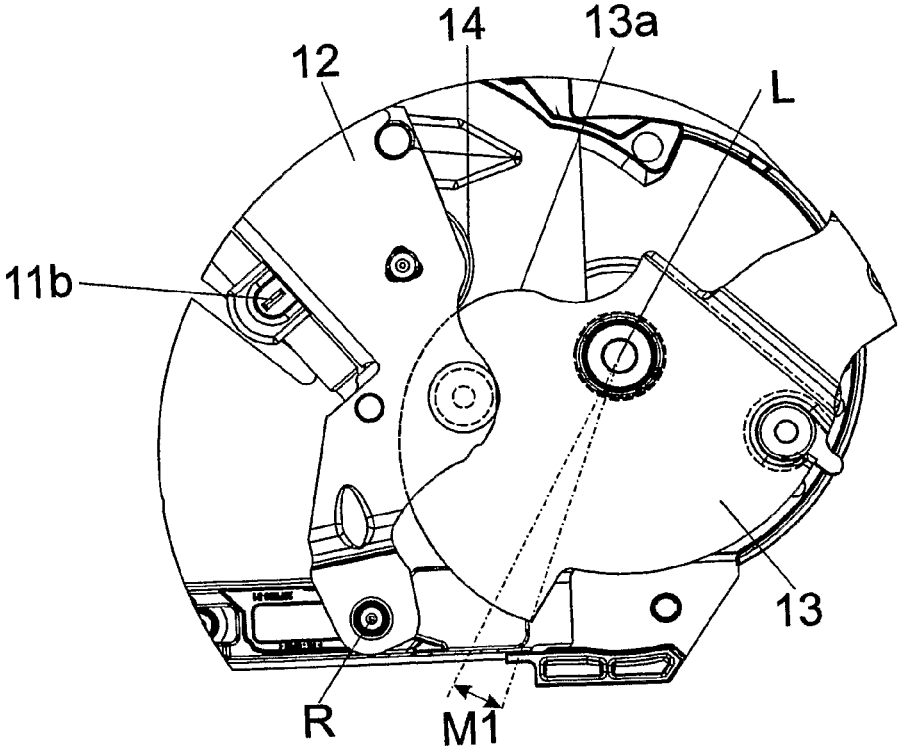

FIG. 5*b* shows an enlarged view of the region circled in FIG. 5*a*. It is possible to see the intermediate lever 12 which is pivotable about the axis of rotation R and on which the displaceably mounted spring mounting 11*b* is arranged. The pressure roller 14 is pressed against the actuating contour 13*a* of the control cam 13 mounted about the axis of rotation L, the pressure roller 14 running against the peripheral edge (actuating contour 13*a*) of the control cam 13. The Figure diagrammatically shows the first rotary angle range M1, wherein the radial spacing—with respect to the axis of rotation L of the control cam 13—of the actuating contour 13*a* is at least approximately the same in that rotary angle range M1 (i.e., the radius is uniform). In that way, substantially no force is exerted on the actuating arm 6 (and thus on the flap 2) by the spring device 4 so that the flap 2, starting from the completely closed position, is movable into an open position by an ejector device 5 which applies a relatively low force.

The present invention is not limited to the illustrated embodiment, and includes or extends to all variants and technical equivalents which can fall within the scope of the claims appended hereto. The positional references adopted in the description such as for example up, down, right and so forth are related to the directly described and illustrated Figure and are to be appropriately transferred to the new position upon a change in position.

The invention claimed is:

1. A drive device for moving a flap of an article of furniture, said drive device comprising:

an actuating arm to be connected to the flap;

a spring device configured to act on said actuating arm so as to move the flap; and an ejector device for moving the flap through a first opening angle range from a closed position in an opening direction toward an open position;

wherein said spring device is configured to exert substantially no force on said actuating arm as said ejector device moves the flap through the first opening angle range, and said spring device is configured to exert force on said actuating arm and thereby move the flap in the opening direction through a second opening angle range adjacent to the first opening angle range.

2. The drive device according to claim 1, wherein said actuating arm is configured to allow the flap to move through a third opening angle range adjoining the second opening angle range, said spring device being configured to hold said actuating arm and the flap in a substantially tared relationship in the third opening angle range.

3. The drive device according to claim 1, wherein said first opening angle range extends between 0° and 10° in the opening direction starting from a completely closed position of the flap.

4. The drive device according to claim 3, wherein said first opening angle range extends between 0° and 5° in the opening direction starting from a completely closed position of the flap.

5. The drive device according to claim 1, wherein said second opening angle range is operative up to about 30° in the opening direction starting from an end of the first opening angle range.

6. The drive device according to claim 1, further comprising:

a control cam mounted about an axis of rotation and having an actuating contour, said control cam being operative between said spring device and said actuating arm; and a pressure roller linked to said spring device and configured to roll against said actuating contour of said control cam during a pivoting movement of said actuating arm.

7. The drive device according to claim 6, wherein said control cam and said pressure roller are configured so that a curved portion of said actuating contour engaging with said pressure roller when the flap is moved through said first opening angle range of the flap has an approximately uniform radius relative to said axis of rotation of said control cam.

8. The drive device according to claim 1, wherein said spring device and said ejector device are arranged in a common structural unit.

9. The drive device according to claim 1, wherein said spring device and said ejector device are arranged in respective separate structural units spaced apart from each other.

10. The drive device according to one claim 1, wherein said ejector device is configured to act on the flap.

11. The drive device according to claim 1, wherein said ejector device is configured to act on said actuating arm.

12. The drive device according to claim 1, wherein said ejector device includes an ejector element and a lockable force storage member for acting on said ejector element so as to eject the flap.

13. The drive device according to claim 1, further comprising a restraining device for holding the flap in a closed position.

14. The drive device according to claim 13, wherein said restraining device includes a first portion to be arranged on a furniture carcass and a second portion to be arranged on the flap, wherein said first portion and said second portion exert a magnetic attraction force on each other in the closed position of the flap.

15. The drive device according to claim 1, wherein said drive device comprises only one spring device.

16. The drive device according to claim 1, wherein said spring device is configured to exert force on said actuating arm only through the second opening angle range.

17. An article of furniture comprising:

a furniture flap; and a drive device according to claim 16 for moving said furniture flap.

* * * * *